US012510095B2

(12) United States Patent
Hatakenaka et al.

(10) Patent No.: US 12,510,095 B2
(45) Date of Patent: Dec. 30, 2025

(54) IMPELLER, FAN, AND AIR-CONDITIONING APPARATUS

(71) Applicant: Mitsubishi Electric Corporation, Tokyo (JP)

(72) Inventors: Kisho Hatakenaka, Tokyo (JP); Tomoya Fukui, Tokyo (JP); Kenichi Sakoda, Tokyo (JP); Tetsuji Saikusa, Tokyo (JP); Yuki Nakao, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 18/836,375

(22) PCT Filed: Feb. 21, 2022

(86) PCT No.: PCT/JP2022/006822
§ 371 (c)(1),
(2) Date: Aug. 7, 2024

(87) PCT Pub. No.: WO2023/157271
PCT Pub. Date: Aug. 24, 2023

(65) Prior Publication Data

US 2025/0198423 A1 Jun. 19, 2025

(51) Int. Cl.
*F04D 29/38* (2006.01)
*F04D 19/00* (2006.01)
(Continued)

(52) U.S. Cl.
CPC ..... *F04D 29/384* (2013.01); *F04D 19/002* (2013.01); *F04D 29/325* (2013.01); *F04D 29/666* (2013.01); *F24F 1/38* (2013.01)

(58) Field of Classification Search
CPC .... F04D 19/002; F04D 29/325; F04D 29/384; F04D 29/666; F24F 1/38
(Continued)

(56) References Cited

U.S. PATENT DOCUMENTS 8,007,243 B2 * 8/2011 Arinaga ..... F04D 29/667 416/235
11,067,093 B2 * 7/2021 Tadokoro ..... F04D 29/384
(Continued)

FOREIGN PATENT DOCUMENTS

CN 104180503 A 12/2014
EP 2 806 221 A2 11/2014
(Continued)

OTHER PUBLICATIONS

International Search Report and Written Opinion mailed on May 17, 2022, received for International Application No. PCT/JP2022/006822, filed on Feb. 21, 2022, 08 pages including English Translation.
(Continued)

*Primary Examiner* — Nathaniel E Wiehe
*Assistant Examiner* — Justin A Pruitt
(74) *Attorney, Agent, or Firm* — XSENSUS LLP

(57) ABSTRACT

An impeller includes a blade including, at its leading edge part, a first leading-edge-side concavity, a leading-edge-side convexity, and a second leading-edge-side concavity, which are positioned in sequence from a radially middle part to an outboard edge part. The first leading-edge-side concavity is a part where the suction side of the impeller is concave. The leading-edge-side convexity is a part where the suction side is convex. The second leading-edge-side concavity is a part where the suction side is concave. At the leading edge part of the blade, the blade has a blade height defined in a direction along the rotational axis of the impeller toward the suction side. The blade height decreases monotonically from the radially middle part toward a first leading-edge-side stationary point, and increases monotonically from the first leading-edge-side stationary point toward a second leading-edge-side inflection point.

8 Claims, 11 Drawing Sheets

(51) Int. Cl.
*F04D 29/32* (2006.01)
*F04D 29/66* (2006.01)
*F24F 1/38* (2011.01)

(58) Field of Classification Search
USPC ..... 415/177
See application file for complete search history.

(56) References Cited

U.S. PATENT DOCUMENTS

| | | | | |
|---|---|---|---|---|
| 11,149,742 | B2 * | 10/2021 | Honma | F24F 1/38 |
| 12,012,969 | B2 * | 6/2024 | Chen | F04D 29/384 |
| 12,326,098 | B2 * | 6/2025 | Martensson | F04D 29/324 |
| 2014/0338388 | A1 | 11/2014 | Kim et al. | |
| 2019/0024674 | A1 | 1/2019 | Loercher et al. | |

FOREIGN PATENT DOCUMENTS

| | | | | | |
|---|---|---|---|---|---|
| EP | 3085966 | A1 | | 10/2016 | |
| JP | 2011-179331 | A | | 9/2011 | |
| JP | 2011179330 | | * | 9/2011 | F04D 29/384 |
| JP | WO2018020708 | | * | 2/2018 | F04D 29/66 |
| JP | 2018-526569 | A | | 9/2018 | |
| WO | 2015/092924 | A1 | | 6/2015 | |
| WO | 2019/035153 | A1 | | 2/2019 | |

OTHER PUBLICATIONS

Extended European Search Report issued Mar. 3, 2025 in European Patent Application No. 22927172.1, 6 pages.

* cited by examiner

IMPELLER, FAN, AND AIR-CONDITIONING APPARATUS

CROSS-REFERENCE TO RELATED APPLICATION

This application is a national stage application, pursuant to 35 U.S.C. § 371, of International Patent Application No. PCT/JP2022/006822, filed Feb. 21, 2022, the entire contents of which are incorporated herein by reference.

TECHNICAL FIELD

The present disclosure relates to an impeller, a fan, and an air-conditioning apparatus.

BACKGROUND ART

Much of the work performed by a blade of an impeller is produced at the outboard part of the blade. This means that the efficiency of the impeller is generally improved by increasing the amount of work produced at the outboard part of the blade. Impeller noise is reduced by reducing strong vortices generated from the impeller. Although directing more airflow toward the outboard part of the blade allows more work to be produced at the outboard part of the blade, this also leads to generation of strong vortices that become a source of noise, and consequently to deterioration of noise. Factors leading to generation of strong vortices that become a source of noise include, for instance, turbulence due to collapse of a blade tip vortex generated in the vicinity of the outboard edge part of the blade, and interference between the blade tip flow and a bellmouth. That is, to provide an impeller with high efficiency and low noise, it is necessary to direct more airflow toward the outboard part of the blade and, at the same time, reduce generation of strong vortices. In other words, for an impeller-equipped fan to have high efficiency and low noise, it is necessary to direct more airflow toward the outboard part of the blade and, at the same time, reduce generation of strong vortices.

From the above-mentioned viewpoint, some proposed impeller-equipped fans in the related art are designed to achieve improved efficiency and reduced noise (see Patent Literature 1). More specifically, a fan described in Patent Literature 1 includes an impeller, and an orifice ring surrounding the outboard part of the discharge side of the impeller. The impeller includes a hub attached to a motor, and a plurality of vanes disposed around the hub. The orifice ring includes a first orifice ring, a second orifice ring, and a curved portion. The first orifice ring is substantially cylindrical, and has a discharge-side distal end being an open end. The second orifice ring is disposed outside the first orifice ring. The second orifice ring is substantially concentric with the first orifice ring, and has an axial height greater than that of the first orifice ring. The curved portion smoothly connects the suction side of the first orifice ring and the suction side of the second orifice ring. Each vane of the fan described in Patent Literature 1 is shaped as described below. In circumferential cross-section, the vane has an airfoil shape at locations near the hub, and has the shape of a thin flat plate or an airfoil shape at locations outboard of a predetermined radius. In radial cross-section, the vane has, at the outboard part of the vane, a curved shape that is concave on the suction side, and has, at locations near the hub, a curved shape that is convex on the suction side. The fan described in Patent Literature 1 is configured as described above to mitigate disturbances in blade tip vortex, and consequently to improve efficiency and reduce noise. As used herein, the term radial direction refers to a direction from the rotational axis of the impeller and perpendicular to the rotational axis.

CITATION LIST

Patent Literature

Patent Literature 1: Japanese Unexamined Patent Application Publication No. 2011-179331

SUMMARY OF INVENTION

Technical Problem

As described above, in radial cross-section, the vanes, that is, the blades of the impeller described in Patent Literature 1 each have, at the outboard part, a shape that is concave on the suction side. That is, at the outboard part of the blade, the pressure surface is convex on the discharge side. The convex part of the pressure surface is configured such that in a portion of the convex part from the vertex of the convexity of the convex part to the outboard edge part of the blade, a normal extending from the pressure surface in the direction of air discharge is directed outboard from the inboard part of the impeller. Radial components of the normal that are directed outboard from the inboard part of the impeller increase in magnitude from the vertex of the convexity toward the outboard edge part of the blade. Accordingly, when air passes through the convex part of the pressure surface at the outboard part of the blade, the air experiences, in the region between the vertex of the convexity and the outboard edge part of the blade, a force that is directed toward the outboard part of the impeller. Further, radial components of the force that are directed outboard from the inboard part of the impeller increase in magnitude from the vertex of the convexity toward the outboard edge part of the blade. For this reason, the impeller described in Patent Literature 1 is prone to air leakage from the outboard side of the outboard edge part of the blade. This prevents an increase in static pressure. Consequently, efficiency does not improve sufficiently. That is, impellers according to the related art still fall short of fully achieving both improved efficiency and reduced noise.

The present disclosure is directed to addressing the above-mentioned problem. It is a first aspect of the present disclosure to provide an impeller that makes it possible to achieve both improved efficiency and reduced noise. It is a second aspect of the present disclosure to provide a fan including the impeller, and an air-conditioning apparatus including the impeller.

Solution to Problem

An impeller according to an embodiment of the present disclosure includes a boss part, and a blade. The boss part is configured to rotate about a rotational axis. The blade is disposed on an outer periphery of the boss part. The blade is rotatable about the rotational axis together with the boss part. The blade includes a leading edge part, a trailing edge part, an outboard edge part, and an inboard edge part. The leading edge part is an edge part located forward in a rotational direction of the blade. The trailing edge part is an edge part located rearward in the rotational direction. The outboard edge part is an edge part located at an outboard part of the blade. The inboard edge part is an edge part located at an inboard part of the blade. A direction from the rotational axis and perpendicular to the rotational axis is a radial direction. A position on the blade that is midway between the outboard edge part and the inboard edge part is a radially middle part. The blade has a plurality of cylindrical cross-sections centered on the rotational axis. In each of the plurality of cylindrical cross-sections, points where a distance from the leading edge part and a distance from the trailing edge part have a predetermined ratio relative to each other are extracted, and the extracted points are interconnected from the inboard edge part to the outboard edge part to define a span line. The span line includes a middle span line, and a leading-edge-side span line. The middle span line is defined by interconnecting, from the inboard edge part to the outboard edge part, the points that are equidistant from the leading edge part and the trailing edge part. The leading-edge-side span line is located closer to the leading edge part than is the middle span line. The blade has a spanwise cross-section. The span-wise cross-section is defined as a cross-section taken along the span line and parallel to the rotational axis. A point on the outer periphery of the boss part is a mid-boss point. The point is a midpoint between an end of the leading edge part that is an end located at the boss part, and an end of the trailing edge part that is an end located at the boss part. An imaginary plane passing through the mid-boss point and perpendicular to the rotational axis is a mid-boss Imaginary plane. The blade has a blade height. The blade height is defined as a distance between the mid-boss imaginary plane and the blade in a direction of the rotational axis. In the span-wise cross-section taken along the leading-edge-side span line, the blade has, in sequence from the radially middle part to the outboard edge part, a first leading-edge-side concavity, a leading-edge-side convexity, and a second leading-edge-side concavity. The first leading-edge-side concavity is a part where a suction side of the impeller is concave. The leading-edge-side convexity is a part where the suction side is convex. The second leading-edge-side concavity is a part where the suction side is concave. A first leading-edge-side inflection point is defined as a boundary point between the first leading-edge-side concavity and the leading-edge-side convexity defines. A second leading-edge-side inflection point is defined as a boundary point between the leading-edge-side convexity and the second leading-edge-side concavity. The blade has a first leading-edge-side stationary point, a second leading-edge-side stationary point, and a third leading-edge-side stationary point. The first leading-edge-side stationary point is located between the radially middle part and the first leading-edge-side inflection point. The second leading-edge-side stationary point is located between the first leading-edge-side inflection point and the second leading-edge-side inflection point. The third leading-edge-side stationary point is located between the second leading-edge-side inflection point and the outboard edge part. The blade height in a region between the radially middle part and the first leading-edge-side stationary point decreases monotonically from the radially middle part toward the first leading-edge-side stationary point. The blade height in a region between the first leading-edge-side stationary point and the second leading-edge-side stationary point increases monotonically from the first leading-edge-side stationary point toward the second leading-edge-side stationary point. The blade height in a region between the second leading-edge-side stationary point and the third leading-edge-side stationary point increases monotonically from the second leading-edge-side stationary point toward the third leading-edge-side stationary point. The blade height in a region between the third leading-edge-side stationary point and the outboard edge part increases monotonically from the third leading-edge-side stationary point toward the outboard edge part.

A fan according to an embodiment of the present disclosure includes the impeller according to an embodiment of the present disclosure, and a bellmouth surrounding an outboard part of the impeller. The bellmouth has a height Hb in the direction of the rotational axis. A suction-side imaginary plane is defined as an imaginary plane that is perpendicular to the rotational axis, and that is spaced apart by 0.5Hb in the direction of the rotational axis from an end of the bellmouth, which is an end near the suction side. A discharge-side imaginary plane is defined as an imaginary plane that is perpendicular to the rotational axis, and that is spaced apart by 0.5Hb in the direction of the rotational axis from an end of the bellmouth, which is an end near the discharge side. The impeller is disposed between the suction-side imaginary plane and the discharge-side imaginary plane.

An air-conditioning apparatus according to an embodiment of the present disclosure includes the impeller according to an embodiment of the present disclosure, and a heat exchanger. The heat exchanger is configured to exchange heat between air supplied by the impeller, and refrigerant circulating inside the heat exchanger.

Advantageous Effects of Invention

The impeller according to an embodiment of the present disclosure makes it possible to increase the amount of work produced at the outboard part of the blade, which accounts for much of the overall work performed by the blade, and also to reduce leakage of air from the outboard side of the outboard edge part of the blade. The impeller according to an embodiment of the present disclosure also makes it possible to promote generation of a blade tip vortex, and to reduce turbulence resulting from collapse of the blade tip vortex. This makes it possible to reduce generation of strong vortices that become a source of noise, and consequently to reduce noise. The impeller according to an embodiment of the present disclosure therefore makes it possible to achieve both improved efficiency and reduced noise.

DESCRIPTION OF EMBODIMENTS

Figure 1:
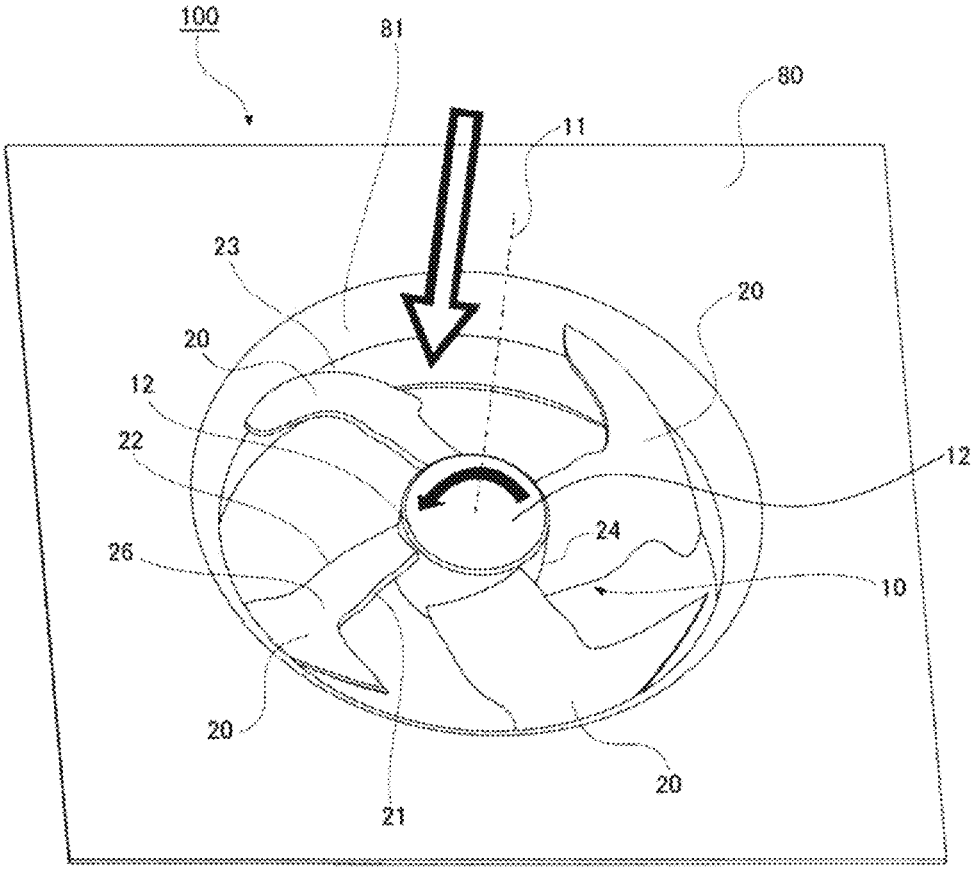
FIG. 1 illustrates, in perspective view, the configuration of a fan including an impeller according to Embodiment 1.

In embodiments below, an impeller according to an illustrative example of the present disclosure, a fan according to an illustrative example of the present disclosure, or an air-conditioning apparatus according to an illustrative example of the present disclosure are described with reference to the drawings. In the drawings described below including FIG. 1, individual components may in some cases differ in their relative dimensions, shapes, or other details from those of the actually manufactured impeller, fan, and air-conditioning apparatus according to the present disclosure. In the drawings described below, features designated by the same reference signs represent the same or corresponding features. The above description, that is, designating the same or corresponding features by the same reference signs, applies throughout the specification. In the following description of the embodiments, directional terms are used as appropriate to facilitate understanding of the impeller, the fan and the air-conditioning apparatus according to illustrative examples of the present disclosure. Examples of directional terms include "upper", "lower", "right", "left, "front", and "rear." Such directional terms, however, are used only for the convenience of description, and not to be construed as limiting of the impeller, the fan, and the air-conditioning apparatus according to the present disclosure. Further, although no chamfering is applied to the shapes in the drawings described below, effects similar to those of the present disclosure can be attained even if chamfering is applied. That is, for example, effects similar to those of the present disclosure can be attained even if 45-degree chamfering (C-chamfering) or rounded chamfering (R-chamfering) is applied.

Embodiment 1

FIG. 1 illustrates, in perspective view, the configuration of a fan including an impeller according to Embodiment 1.

It is to be noted that FIG. 1 is a perspective view of a fan 100 as seen toward the suction side of the fan 100. In other words, FIG. 1 is a perspective view of the fan 100 as seen toward the suction side of an impeller 10. That is, FIG. 1 is a perspective view of the fan 100 as seen toward a suction surface 26 of the impeller 10. A thick filled arrow in FIG. 1 and in other figures described later represents the direction of rotation of the impeller 10. That is, a thick filled arrow in FIG. 1 and in other figures described later represents the direction in which a boss part 12 and blades 20 of the impeller 10 rotate. A thick open arrow in FIG. 1 and in other figures described later represents the overall direction of airflow when the impeller 10 rotates. The fan 100 according to Embodiment 1 is an axial fan that sends air in the direction of a rotational axis 11 of the impeller 10.

As illustrated in FIG. 1, the fan 100 includes the impeller 10, and a bellmouth 81 surrounding the outboard part of the impeller 10. According to Embodiment 1, a casing 80 includes the bellmouth 81. The bellmouth 81 is substantially cylindrical in shape. The impeller 10 is disposed inboard of the bellmouth 81 shaped as described above. The impeller 10 is rotatable about the rotational axis 11.

The impeller 10 includes the boss part 12 disposed along the rotational axis 11, and a plurality of blades 20 disposed on the outer periphery of the boss part 12. The boss part 12 is substantially cylindrical in shape. The central portion of the boss part 12 is connected with a drive shaft of a drive part (not illustrated) such as a motor. The drive part causes the impeller 10 to rotate. The boss part 12 rotates about the rotational axis 11 when a rotational drive force is transmitted to the boss part 12 from the drive part via the drive shaft.

The blades 20 are disposed at equal angular intervals on the outer periphery of the boss part 12. The blades 20 project in a generally radial configuration from the outer peripheral wall of the boss part 12. More specifically, each of the blades 20 projects radially outboard of the boss part 12 from the outer peripheral wall of the boss part 12 in such a way that the blade 20 is swept forward in the direction of rotation of the impeller 10. As used herein, the term radial direction refers to a direction from the rotational axis 11 and perpendicular to the rotational axis 11. Although FIG. 1 illustrates an example in which the impeller 10 has four blades 20, the impeller 10 may have a number of blades 20 other than four.

The blades 20 rotate about the rotational axis 11 together with the boss part 12. As the blades 20 rotates, air is sucked into the fan 100 along the rotational axis 11 from the near side of FIG. 1 as indicated by the thick open arrow in FIG. 1. The air sucked into the fan 100 is discharged along the rotational axis 11 from the fan 100 toward the far side of FIG. 1.

Figure 2:
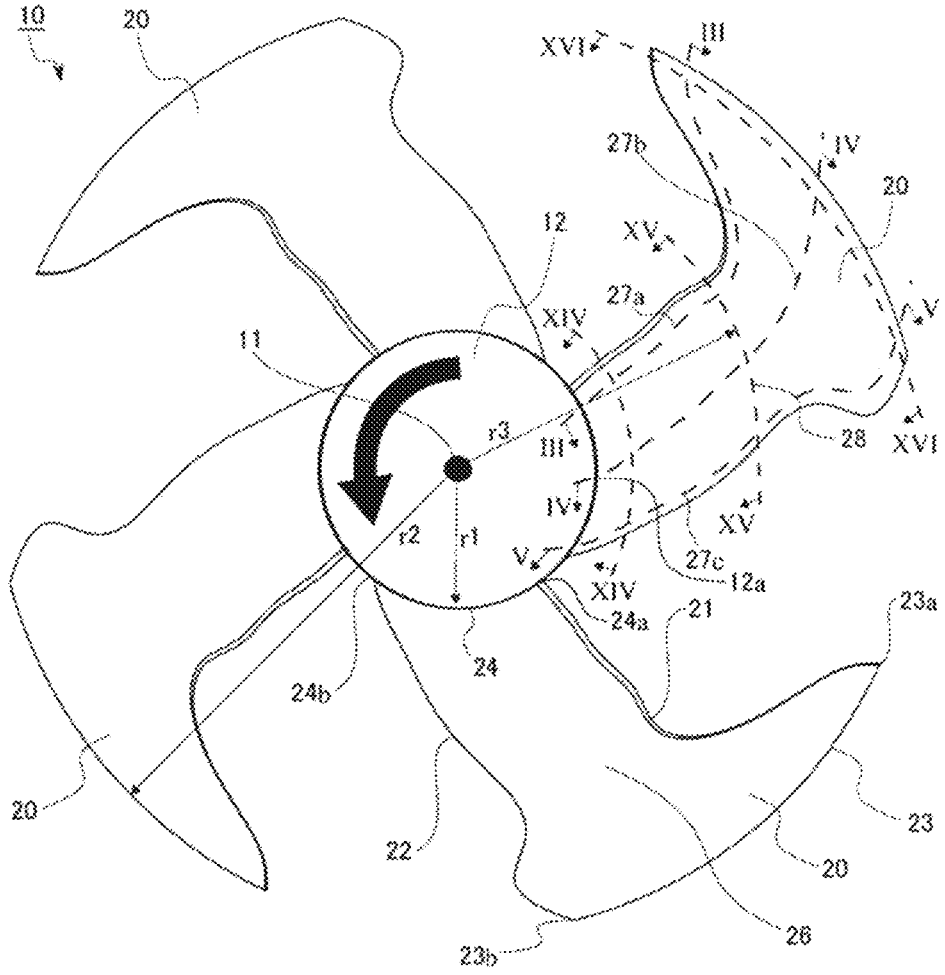
FIG. 2 is an illustration for explaining the names of various parts or portions of the impeller according to Embodiment 1, depicting the impeller projected onto a plane perpendicular to the rotational axis of the impeller.

FIG. 2 is an illustration for explaining the names of various parts or portions of the impeller according to Embodiment 1, depicting the impeller projected onto a plane perpendicular to the rotational axis of the impeller.

Reference is now made to FIG. 2 to explain the names of various parts or portions of the impeller 10 according to Embodiment 1. The illustration of the impeller 10 in FIG. 2 is only for the purpose of explaining the names of various parts or portions of the impeller 10 according to Embodiment 1. It is thus to be noted that the impeller 10 illustrated in FIG. 2 differs in shape from the impeller 10 according to Embodiment 1. FIG. 2 is a view of the impeller 10 as seen toward the suction surface 26 of each blade 20.

Each of the blades 20 includes a leading edge part 21, a trailing edge part 22, an outboard edge part 23, and an inboard edge part 24. The leading edge part 21 is a portion of the peripheral edge part of the blade 20 that defines a forward edge part in the rotational direction of the blade 20. The trailing edge part 22 is a portion of the peripheral edge part of the blade 20 that defines a rearward edge part in the rotational direction of the blade 20. The outboard edge part 23 is a portion of the peripheral edge part of the blade 20 that defines an edge part located at the outboard part. The inboard edge part 24 is a portion of the peripheral edge part of the blade 20 that defines an edge part located at the inboard part. The inboard edge part 24 conforms in shape to the outer periphery of the boss part 12. The inboard edge part 24 is connected to the outer periphery of the boss part 12.

The outboard edge part 23 is connected at an outboard leading end 23*a* to the leading edge part 21. The outboard edge part 23 is connected at an outboard trailing end 23*b* to the trailing edge part 22. The inboard edge part 24 is connected at an inboard leading end 24*a* to the leading edge part 21. The inboard edge part 24 is connected at an inboard trailing end 24*b* to the trailing edge part 22.

Each of the blades 20 has a radially middle part 28. The radially middle part 28 is defined as a radial location on the blade 20 that is midway between the outboard edge part 23 and the inboard edge part 24. In other words, the radially middle part 28 lies on an imaginary circle centered on the rotational axis 11. With the impeller 10 observed in the direction of the rotational axis 11, with respect to the radial direction running on the blade 20, the distance from the rotational axis 11 to the inboard edge part 24 is r1, the distance from the rotational axis 11 to the outboard edge part 23 is r2, and the distance from the rotational axis 11 to the radially middle part 28 is r3. In this case, the following relationship is satisfied: $r3=(r1+r2)/2$.

Each of the blades 20 has a pressure surface 25, and the suction surface 26. Of the two surfaces of the blade 20, the pressure surface 25 is located forward in the rotational direction of the blade 20. When the blade 20 rotates, air is pushed by the pressure surface 25. FIGS. 1 and 2 each illustrate the fan 100 and the impeller 10 as seen toward the suction surface 26. Thus, the pressure surface 25 is not illustrated in FIGS. 1 and 2. Accordingly, as for the pressure surface 25, reference is to be made to FIG. 3 described later. Of the two surfaces of the blade 20, the suction surface 26 is located rearward in the rotational direction of the blade 20. The suction surface 26 is a surface opposite from the pressure surface 25.

A span line is defined as described below. The blade 20 has a plurality of cylindrical cross-sections centered on the rotational axis 11. In each of the cylindrical cross sections, points where the distance from the leading edge part 21 and the distance from the trailing edge part 22 have a predetermined ratio relative to each other are extracted, and the extracted points are interconnected from the inboard edge part 24 to the outboard edge part 23 to define a span line. The distance from the leading edge part 21, and the distance from the trailing edge part 22 are each measured, for example, along the camber line of the blade 20 on each cylindrical cross-section. FIG. 2 illustrates, as such a span line, a leading-edge-side span line 27*a*, a middle span line 27*b*, and a trailing-edge-side span line 27*c*. The middle span line 27*b* is a span line defined by interconnecting, from the inboard edge part 24 to the outboard edge part 23, points that are equidistant from the leading edge part 21 and the trailing edge part 22. The leading-edge-side span line 27*a* is a span line located closer to the leading edge part 21 than is the middle span line 27*b*. The trailing-edge-side span line 27*c* is a span line located closer to the trailing edge part 22 than is the middle span line 27*b*. With the length along a span line from the inboard edge part 24 to the outboard edge part 23 being defined as R, the length along the span line from the inboard edge part 24 to the radially middle part 28 is not necessarily equal to 0.5R but is generally within a range of 0.45R to 0.55R.

A cross-section of each blade 20 taken along a span line and parallel to the rotational axis 11 is defined as a span-wise cross-section.

Figure 3:
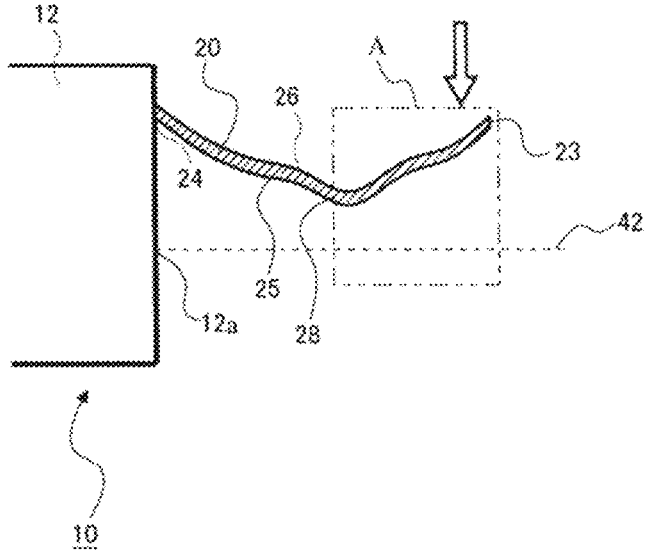
FIG. 3 illustrates a blade of the impeller according to Embodiment 1 in span-wise cross-section taken along a leading-edge-side span line.
Figure 4:
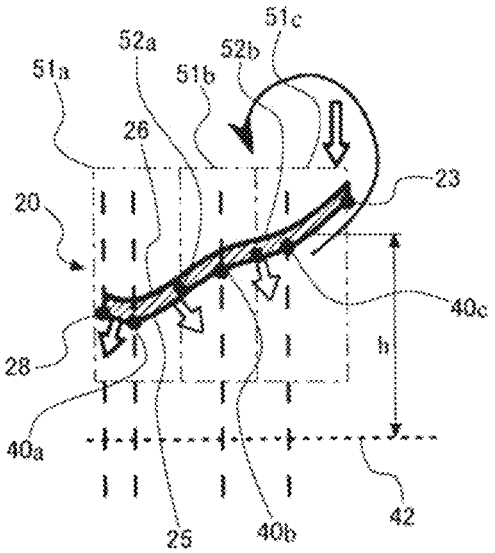
FIG. 4 is an enlarged view of Part A of FIG. 3.
Figure 5:
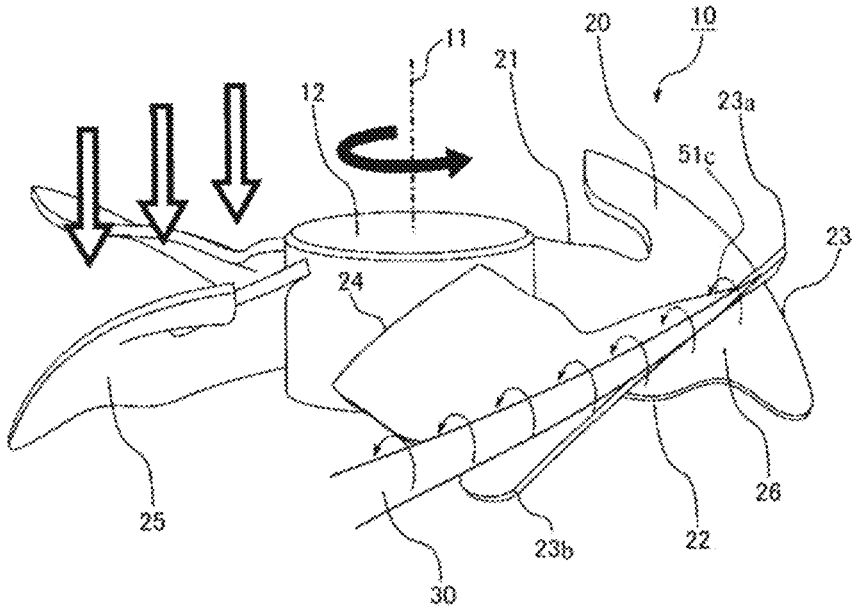
FIG. 5 is a perspective view of the impeller according to Embodiment 1 as seen toward the suction side of the impeller, illustrating an example of a blade tip vortex generated by the impeller.

FIG. 3 illustrates a blade of the impeller according to Embodiment 1 in span-wise cross-section taken along the leading-edge-side span line. FIG. 4 is an enlarged view of Part A of FIG. 3. FIG. 5 is a perspective view of the impeller according to Embodiment 1 as seen toward the suction side of the impeller, illustrating an example of a blade tip vortex generated by the impeller.

In other words, FIGS. 3 and 4 each illustrate the blade 20 of the impeller 10 according to Embodiment 1 in cross-section taken along the plane III-III illustrated in FIG. 2. That is, the up-down direction in the plane of FIGS. 3 and 4 represents the direction along the rotational axis 11. The upper side in the plane of FIGS. 3 and 4 represents the suction side of the impeller 10, and the lower side in the plane of FIGS. 3 and 4 represents the discharge side of the impeller 10. Reference is now made to FIGS. 3 to 5 to describe the shape of the blade 20 of the impeller 10 according to Embodiment 1 in span-wise cross-section taken along the leading-edge-side span line 27*a*, and effects provided by the shape.

As illustrated in FIGS. 3 and 4, in span-wise cross-section taken along the leading-edge-side span line 27*a*, the blade 20 has, for example, over the entire region between the radially middle part 28 and the outboard edge part 23, a curved shape such that the suction surface 26, that is, the suction side is curved in a concave-convex-concave sequence from the radially middle part 28 to the outboard edge part 23. In other words, at the leading edge part 21, the blade 20 has, in the region between the radially middle part 28 and the outboard edge part 23, a curved shape such that from the radially middle part 28 to the outboard edge part 23, the suction side is curved in a concave-convex-concave sequence and the discharge side is curved in a convex-concave-convex sequence. More specifically, in span-wise cross-section taken along the leading-edge-side span line 27*a*, the blade 20 has a sequence of the following features from the radially middle part 28 to the outboard edge part 23: a first leading-edge-side concavity 51*a* where the suction side of the impeller 10 is concave; a leading-edge-side convexity 51*b* where the suction side of the impeller 10 is convex; and a second leading-edge-side concavity 51*c* where the suction side of the impeller 10 is concave.

Consequently, in span-wise cross-section taken along the leading-edge-side span line 27*a*, the blade 20 has a plurality of stationary points from the radially middle part 28 to the outboard edge part 23. A stationary point is a point where a function representing the slope of the blade 20 relative to an imaginary plane perpendicular to the rotational axis 11 has a zero derivative. In other words, a stationary point is a point where the degree of change in the slope of the blade 20 relative to the imaginary plane perpendicular to the rotational axis 11 is zero.

More specifically, in span-wise cross-section taken along the leading-edge-side span line 27*a*, a first leading-edge-side inflection point 52*a* is defined as the boundary point between the first leading-edge-side concavity 51*a* and the leading-edge-side convexity 51*b*, and a second leading-edge-side inflection point 52*b* is defined as the boundary point between the leading-edge-side convexity 51*b* and the second leading-edge-side concavity 51*c*. With the first leading-edge-side inflection point 52*a* and the second leading-edge-side inflection point 52*b* defined as described above, the blade 20 has, in span-wise cross-section taken along the leading-edge-side span line 27*a*, a first leading-edge-side stationary point 40*a* between the radially middle part 28 and the first leading-edge-side inflection point 52*a*. In span-wise cross-section taken along the leading-edge-side span line 27*a*, the blade 20 has a second leading-edge-side stationary point 40*b* between the first leading-edge-side inflection point 52*a* and the second leading-edge-side inflection point 52*b*. In span-wise cross-section taken along the leading-edge-side span line 27*a*, the blade 20 has a third leading-edge-side stationary point 40*c* between the second leading-edge-side inflection point 52*b* and the outboard edge part 23.

According to Embodiment 1, the first leading-edge-side stationary point 40*a*, the second leading-edge-side stationary point 40*b*, and the third leading-edge-side stationary point 40*c* exist at positions described below. With the impeller 10 observed in the direction of the rotational axis 11, with respect to the radial direction running on the blade 20, the distance from the rotational axis 11 to a given point on the blade 20 is denoted as r. As described above, with the impeller 10 observed in the direction of the rotational axis 11, with respect to the radial direction running on the blade 20, the distance from the rotational axis 11 to the inboard edge part 24 is r1, and the distance from the rotational axis 11 to the outboard edge part 23 is r2. Further, v is defined as $v=(r-r1)/(r2-r1)$. In this case, the first leading-edge-side stationary point 40*a* exists within the range $0.5<v<0.7$. The second leading-edge-side stationary point 40*b* exists within the range $0.65<v<0.85$. The third leading-edge-side stationary point 40*c* exists within the range $0.8<v<1$.

In span-wise cross-section taken along the leading-edge-side span line 27*a*, the blade 20 has a blade height h as described below. Now, the blade height h is described first. As illustrated in FIGS. 2 and 3, a mid-boss point 12*a* is defined as a point on the outer periphery of the boss part 12 that is the midpoint between the following two ends: an end of the leading edge part 21 that is an end located at the boss part 12; and an end of the trailing edge part 22 that is an end located at the boss part 12. That is, the mid-boss point 12*a* is defined as a point on the outer periphery of the boss part 12 that is the midpoint between the inboard leading end 24*a* and the inboard trailing end 24*b*. The midpoint between the inboard leading end 24*a* and the inboard trailing end 24*b* is measured, for example, along the camber line of the blade 20 at the inboard edge part 24. As illustrated in FIGS. 3 and 4, an imaginary plane passing through the mid-boss point 12*a* and perpendicular to the rotational axis 11 is defined as a mid-boss imaginary plane 42. With the mid-boss imaginary plane 42 defined as described above, the blade height h is the distance, in the direction of the rotational axis 11, between the mid-boss imaginary plane 42 and the blade 20.

With the blade height h defined as described above, in span-wise cross-section taken along the leading-edge-side span line 27*a*, the blade height h in the region between the radially middle part 28 and the first leading-edge-side stationary point 40*a* decreases monotonically from the radially middle part 28 toward the first leading-edge-side stationary point 40*a*. In span-wise cross-section taken along the leading-edge-side span line 27*a*, the blade height h in the region between the first leading-edge-side stationary point 40*a* and the second leading-edge-side stationary point 40*b* increases monotonically from the first leading-edge-side stationary point 40*a* toward the second leading-edge-side stationary point 40*b*. In span-wise cross-section taken along the leading-edge-side span line 27*a*, the blade height h in the region between the second leading-edge-side stationary point 40*b* and the third leading-edge-side stationary point 40*c* increases monotonically from the second leading-edge-side stationary point 40*b* toward the third leading-edge-side stationary point 40*c*. In span-wise cross-section taken along the leading-edge-side span line 27*a*, the blade height h in the region between the third leading-edge-side stationary point 40*c* and the outboard edge part 23 increases monotonically from the third leading-edge-side stationary point 40*c* toward the outboard edge part 23. As used herein, the expression "increase monotonically" means to keep increasing without decreasing. As used herein, the expression "decrease monotonically" means to keep decreasing without increasing.

The configuration of the impeller 10 according to Embodiment 1 mentioned above effectively allows for reduced noise. This is explained below in more detail. Generally, with axial fans, at the outboard edge part of an impeller blade, the pressure difference between the pressure surface and the suction surface causes airflow to roll from the pressure surface toward the suction surface. This results in generation of a blade tip vortex in the vicinity of the outboard edge part of the blade. If, for instance, the blade tip vortex collapses and creates turbulence, this leads to generation of strong vortices that become a source of noise, and consequently to deterioration of noise. If, for instance, the blade tip flow and the bellmouth interfere with each other, this leads to generation of strong vortices that become a source of noise, and consequently to deterioration of noise.

The impeller 10 according to Embodiment 1 is configured such that, in span-wise cross-section taken along the leading-edge-side span line 27*a*, the blade height h in the region between the third leading-edge-side stationary point 40*c* and the outboard edge part 23 increases monotonically from the third leading-edge-side stationary point 40*c* toward the outboard edge part 23. This facilitates rolling of the airflow from the pressure surface 25 toward the suction surface 26, as indicated by the arrow with a filled head in FIG. 4. Further, the impeller 10 according to Embodiment 1 has a sequence of the following features from the radially middle part 28 to the outboard edge part 23: the first leading-edge-side concavity 51*a* where the suction side of the impeller 10 is concave; the leading-edge-side convexity 51*b* where the suction side of the impeller 10 is convex; and the second leading-edge-side concavity 51*c* where the suction side of the impeller 10 is concave. This configuration allows for increased curvature of the second leading-edge-side concavity 51*c*. In other words, this configuration allows for increased curvature between the third leading-edge-side stationary point 40*c* and the outboard edge part 23. Therefore, as illustrated in FIG. 5, the impeller 10 according to Embodiment 1 is configured to allow promotion of a blade tip vortex 30, and reduce turbulence resulting from collapse of the blade tip vortex 30. This makes it possible to reduce generation of strong vortices that become a source of noise, and consequently to reduce noise. Further, as illustrated in FIG. 5, the blade tip vortex 30 is generated at the location of the second leading-edge-side concavity 51*c*. This helps to also reduce interference with the bellmouth 81. The impeller 10 according to Embodiment 1 therefore allows for further noise reduction.

With the impeller described above with reference to Patent Literature 1 cited in the Citation List section, the radial cross-section of its blade is a curve that, at locations closer to the outboard edge part than are locations near the middle part, has a concave shape on the suction side. Accordingly, as with the impeller 10 according to Embodiment 1, the impeller described in Patent Literature 1 is likewise configured to promote generation of a blade tip vortex, and consequently provide noise reduction. The impeller described in Patent Literature 1, however, fails to provide sufficient efficiency improvement. In contrast, the impeller 10 according to Embodiment 1 not only allows for reduced noise but also allows for improved efficiency relative to the impeller described in Patent Literature 1. The reason for this is described below.

As described above, the blades of the impeller described in Patent Literature 1 each have a radial cross-section such that at the outboard part, the blade is concave on the suction side. That is, at the outboard part of the blade, the pressure surface is convex on the discharge side. The convex part of the pressure surface is configured such that in a portion of the convex part from the vertex of the convexity of the convex part to the outboard edge part of the blade, a normal extending from the pressure surface in the direction of air discharge is directed outboard from the inboard part of the impeller. Radial components of the normal that are directed outboard from the inboard part of the impeller increase in magnitude from the vertex of the convexity toward the outboard edge part of the blade. Accordingly, when air passes through the convex part of the pressure surface at the outboard part of the blade, the air experiences, in the region between the vertex of the convexity and the outboard edge part of the blade, a force that is directed toward the outboard part of the impeller. Further, radial components of the force that are directed outboard from the inboard part of the impeller increase in magnitude from the vertex of the convexity toward the outboard edge part of the blade. That is, the impeller described in Patent Literature 1 is configured such that, as for the force that the pressure surface of the blade exerts on air, radial components of the force that are directed outboard from the inboard part of the impeller increase monotonically in magnitude from the vertex of the convexity toward the outboard edge part of the blade. Therefore, the impeller described in Patent Literature 1 is prone to air leakage from the outboard side of the outboard edge part of the blade. This prevents an increase in static pressure. Consequently, efficiency does not improve sufficiently.

In contrast, the impeller 10 according to Embodiment 1 is configured such that, as for the force that the pressure surface of the blade exerts on air, radial components of the force that are directed outboard from the inboard part of the impeller 10 are as indicated by the open arrows in FIG. 4, that is, the radial components do not increase monotonically in magnitude toward the outboard edge part of the blade 20. More specifically, when air passes through a region of the pressure surface 25 between the first leading-edge-side stationary point 40*a* and the third leading-edge-side stationary point 40*c*, the air experiences a force that is directed toward the outboard part of the impeller 10. In this regard, radial components that are directed outboard from the inboard part of the impeller 10, and that are radial components of the force that air experiences in passing through a region of the pressure surface 25 between the second leading-edge-side stationary point 40*b* and the third leading-edge-side stationary point 40*c*, are smaller in magnitude than radial components that are directed outboard from the inboard part of the impeller 10, and that are radial components of the force that air experiences in passing through a region of the pressure surface 25 between the first leading-edge-side stationary point 40*a* and the second leading-edge-side stationary point 40*b*. As a result, the flow of air pushed by the region of the pressure surface 25 between the second leading-edge-side stationary point 40*b* and the third leading-edge-side stationary point 40*c* helps to reduce movement, toward the outboard part of the impeller 10, of the flow of air pushed by the region of the pressure surface 25 between the first leading-edge-side stationary point 40*a* and the second leading-edge-side stationary point 40*b*. The impeller 10 according to Embodiment 1 therefore makes it possible to reduce leakage of air from the outboard side of the outboard edge part 23 of the blade 20.

As described above, the impeller 10 according to Embodiment 1 is configured such that when air passes through the region of the pressure surface 25 between the first leading-edge-side stationary point 40*a* and the third leading-edge-side stationary point 40*c*, the air experiences a force that is directed toward the outboard part of the impeller 10. This configuration allows more of the airflow through the impeller 10 to be directed toward the outboard part of the impeller 10. Generally, much of the work performed by an impeller blade is produced at the outboard part of the blade. This means that the efficiency of the impeller is generally improved by an increase in the amount of work produced at the outboard part of the blade. In this regard, the configuration of the impeller 10 according to Embodiment 1 makes it possible to increase the amount of work produced at the outboard part of the blade 20, and consequently to improve efficiency.

As described above, the configuration of the impeller 10 according to Embodiment 1 makes it possible to increase the amount of work produced at the outboard part of the blade 20, and also to reduce leakage of air from the outboard side of the outboard edge part 23 of the blade 20. This leads to improved efficiency.

As described above, in span-wise cross-section taken along the leading-edge-side span line 27*a*, the blade height h in the region between the radially middle part 28 and the first leading-edge-side stationary point 40*a* decreases monotonically from the radially middle part 28 toward the first leading-edge-side stationary point 40*a*. This means that as indicated by an open arrow in FIG. 4, in the impeller 10 according to Embodiment 1, air passing through a region of the pressure surface 25 between the radially middle part 28 and the first leading-edge-side stationary point 40*a* experiences a force that is directed toward the boss part 12. The resulting flow of air helps to reduce the risk that a turbulent airflow caused by flow separation at the surface of the boss part 12 is allowed to move toward a part of the impeller 10 located outboard of the radially middle part 28. This makes it possible to streamline airflow at the outboard part of the blade 20, which accounts for much of the overall work performed by the blade 20. In this respect as well, the impeller 10 according to Embodiment 1 has improved efficiency.

As described above, in the impeller 10 according to Embodiment 1, the blade 20 is shaped as described below in span-wise cross-section taken along the leading-edge-side span line 27*a*. The blade 20 has a sequence of the following features from the radially middle part 28 to the outboard edge part 23: the first leading-edge-side concavity 51*a* where the suction side of the impeller 10 is concave; the leading-edge-side convexity 51*b* where the suction side of the impeller 10 is convex; and the second leading-edge-side concavity 51*c* where the suction side of the impeller 10 is concave. The blade height h in the region between the radially middle part 28 and the first leading-edge-side stationary point 40*a* decreases monotonically from the radially middle part 28 toward the first leading-edge-side stationary point 40*a*. The blade height h in the region between the first leading-edge-side stationary point 40*a* and the second leading-edge-side stationary point 40*b* increases monotonically from the first leading-edge-side stationary point 40*a* toward the second leading-edge-side stationary point 40*b*. The blade height h in the region between the second leading-edge-side stationary point 40*b* and the third leading-edge-side stationary point 40*c* increases monotonically from the second leading-edge-side stationary point 40*b* toward the third leading-edge-side stationary point 40*c*. The blade height h in the region between the third leading-edge-side stationary point 40*c* and the outboard edge part 23 increases monotonically from the third leading-edge-side stationary point 40*c* toward the outboard edge part 23.

As described above, the above-mentioned configuration of the impeller 10 according to Embodiment 1 makes it possible to increase the amount of work produced at the outboard part of the blade 20, which accounts for much of the overall work performed by the blade 20, and also to reduce leakage of air from the outboard side of the outboard edge part 23 of the blade 20. Further, as described above, the above-mentioned configuration of the impeller 10 according to Embodiment 1 makes it possible to promote generation of the blade tip vortex 30, and reduce turbulence resulting from collapse of the blade tip vortex 30. This makes it possible to reduce generation of strong vortices that become a source of noise, and consequently to reduce noise. The above-mentioned configuration of the impeller 10 according to Embodiment 1 therefore makes it possible to achieve both improved efficiency and reduced noise.

The fan 100 according to Embodiment 1 includes the impeller 10 configured to allow for both improved efficiency and reduced noise as described above. The fan 100 thus allows for improved efficiency and reduced noise.

Embodiment 2

In Embodiment 1, no particular mention has been made of the shape at the trailing edge part 22 of the blade 20. The trailing edge part 22 of the blade 20 is preferably shaped as described below. Features not particularly mentioned in the following description of Embodiment 2 are assumed to be similar to those described above with reference to Embodiment 1.

Figure 6:
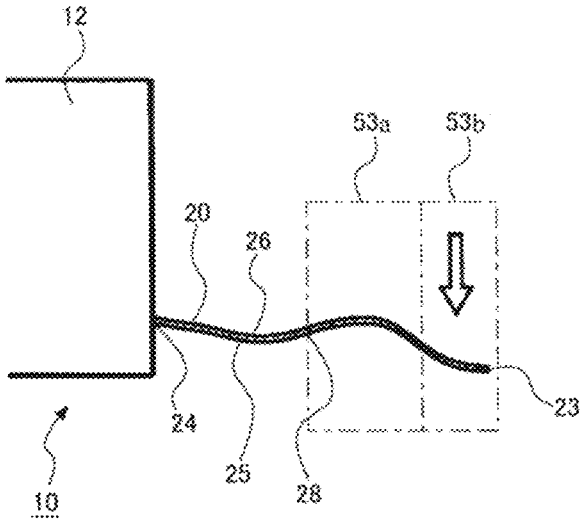
FIG. 6 illustrates a blade of an impeller according to Embodiment 2 in span-wise cross-section taken along a trailing-edge-side span line.

FIG. 6 illustrates a blade of an impeller according to Embodiment 2 in span-wise cross-section taken along the trailing-edge-side span line.

In other words, FIG. 6 illustrates the blade 20 of the impeller 10 according to Embodiment 2 in cross-section taken along the plane V-V illustrated in FIG. 2. That is, the up-down direction in the plane of FIG. 6 represents the direction along the rotational axis 11. The upper side in the plane of FIG. 6 represents the suction side of the impeller 10, and the lower side in the plane of FIG. 6 represents the discharge side of the impeller 10.

As illustrated in FIG. 6, in span-wise cross-section taken along the trailing-edge-side span line 27*c*, the blade 20 has, for example, over the entire region between the radially middle part 28 and the outboard edge part 23, a curved shape such that the suction surface 26, that is, the suction side is curved in a convex-concave sequence from the radially middle part 28 to the outboard edge part 23. In other words, at the trailing edge part 22, the blade 20 has a curved shape in the region between the radially middle part 28 and the outboard edge part 23 such that, from the radially middle part 28 to the outboard edge part 23, the suction side is curved in a convex-concave sequence and the discharge side is curved in a concave-convex sequence. More specifically, in span-wise cross-section taken along the trailing-edge-side span line 27*c*, the blade 20 has a sequence of the following features from the radially middle part 28 to the outboard edge part 23: a trailing-edge-side convexity 53*a* where the suction side of the impeller 10 is convex; and a trailing-edge-side concavity 53*b* where the suction side of the impeller 10 is concave.

Figure 7:
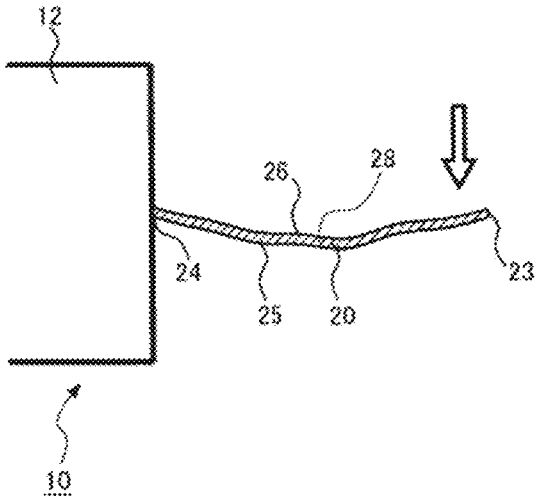
FIG. 7 illustrates a blade of the impeller according to Embodiment 2 in span-wise cross-section taken along a middle span line.

FIG. 7 illustrates a blade of the impeller according to Embodiment 2 in span-wise cross-section taken along the middle span line.

In other words, FIG. 7 illustrates the blade 20 of the impeller 10 according to Embodiment 2 in cross-section taken along the plane IV-IV illustrated in FIG. 2. That is, in FIG. 7, the up-down direction in the plane of the figure represents the direction along the rotational axis 11. The upper side in the plane of FIG. 6 represents the suction side of the impeller 10, and the lower side in the plane of FIG. 6 represents the discharge side of the impeller 10.

Now, a case is considered where the blade 20 has the shape described above with reference to Embodiment 1 in span-wise cross-section taken along the leading-edge-side span line 27*a*, and the blade 20 has the shape described above with reference to Embodiment 2 in span-wise cross-section taken along the trailing-edge-side span line 27*c*. In this case, the blade 20 has, for example, a shape as illustrated in FIG. 7 in span-wise cross-section taken along the middle span line 27*b*. More specifically, as compared with, for example, the shape of the blade 20 in span-wise cross-section taken along each of the leading-edge-side span line 27*a* and the trailing-edge-side span line 27*c*, in span-wise cross-section taken along the middle span line 27*b*, the blade 20 is shaped like a straight line substantially perpendicular to the rotational axis 11.

When the blade 20 has the shape described above with reference to Embodiment 2 in span-wise cross-section taken along the trailing-edge-side span line 27*c*, the flow of incoming air reaching a region of the suction surface 26 where the trailing-edge-side convexity 53*a* exists splits into separate flows. More specifically, upon reaching the region of the suction surface 26 where the trailing-edge-side convexity 53*a* exists, the flow of incoming air splits into separate flows due to the trailing-edge-side convexity 53*a* where the suction surface 26 is convex. One of the flows is directed toward the radially middle part 28, and another is directed toward the outboard edge part 23. In this regard, if the air at the suction surface 26 does not flow along the blade 20 from the leading edge part 21 to the trailing edge part 22 but separates from the suction surface 26 at some point between the two edges parts, the impeller 10 deteriorates in efficiency. If, however, the flow of incoming air reaching the region of the suction surface 26 where the trailing-edge-side convexity 53*a* exists is allowed to split into separate flows as described above, this helps to reduce the risk that the airflow at the suction surface 26 separates from the suction surface 26 at some point. That is, at the suction surface 26, air is allowed to flow along the blade 20 from the leading edge part 21 to the trailing edge part 22. Therefore, by making the blade 20 have the shape described above with reference to Embodiment 2 in span-wise cross-section taken along the trailing-edge-side span line 27*c*, the impeller 10 can be further improved in efficiency.

By making the blade 20 have the shape described above with reference to Embodiment 2 in span-wise cross-section taken along the trailing-edge-side span line 27*c*, airflow is allowed to easily roll around the outboard side of the outboard edge part 23 from the pressure surface 25 toward the suction surface 26 due to the trailing-edge-side concavity 53*b* where the blade 20 is convex on the pressure surface 25.

This means that, by making the blade 20 have the shape described above with reference to Embodiment 2 in span-wise cross-section taken along the trailing-edge-side span line 27*c*, generation of the blade tip vortex 30 is promoted also at the trailing edge part 22 of the blade 20. Therefore, by making the blade 20 have the shape described above with reference to Embodiment 2 in span-wise cross-section taken along the trailing-edge-side span line 27*c*, noise generated by the impeller 10 can be further reduced.

Figure 8:
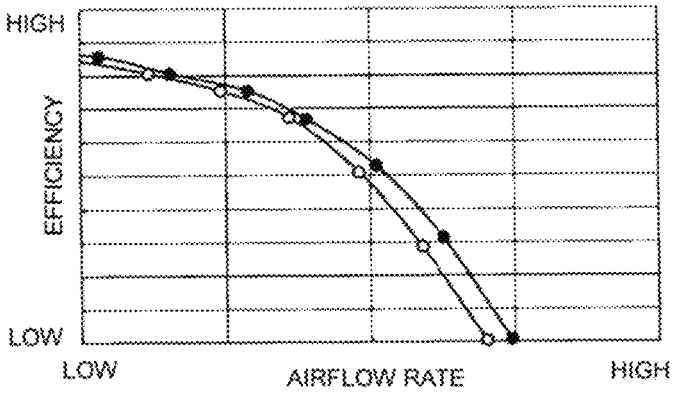
FIG. 8 illustrates a comparison of efficiency between the impeller according to Embodiment 2, and the impeller according to the related art.

FIG. 8 illustrates a comparison of efficiency between the impeller according to Embodiment 2, and the impeller according to the related art.

Filled circles in FIG. 8 represent the examination results on the impeller 10 according to Embodiment 2. Open circles in FIG. 8 represent the examination results on the impeller according to the related art. The impeller according to the related art is a common impeller that does not have the characteristic features of the impeller 10 according to Embodiment 2. It can be appreciated from FIG. 8 that, if the impeller 10 according to Embodiment 2 and the impeller according to the related art are made to generate airflow at the same flow rate, the impeller 10 according to Embodiment 2 exhibits improved efficiency at any airflow rate relative to the impeller according to the related art.

Figure 9:
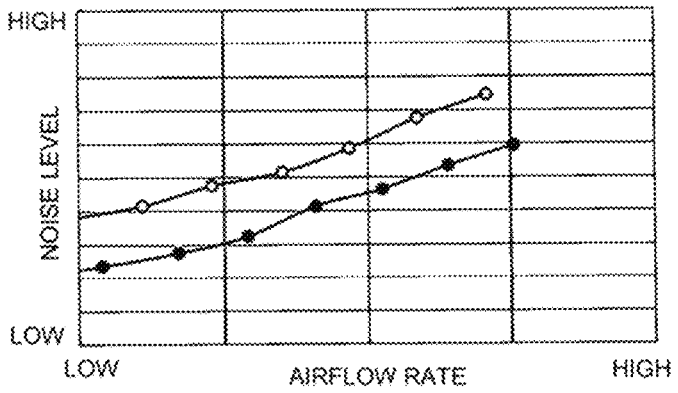
FIG. 9 illustrates a comparison of noise between the impeller according to Embodiment 2, and the impeller according to the related art.

FIG. 9 illustrates a comparison of noise between the impeller according to Embodiment 2, and the impeller according to the related art.

Filled circles in FIG. 9 represent the examination results on the impeller 10 according to Embodiment 2. Open circles in FIG. 9 represent the examination results on the impeller according to the related art. It can be appreciated from FIG. 9 that, if the impeller 10 according to Embodiment 2 and the impeller according to the related art are made to generate airflow at the same flow rate, the impeller 10 according to Embodiment 2 exhibits reduced noise at any airflow rate relative to the impeller according to the related art.

Embodiment 3

When the blade 20 has the shape described above with reference to Embodiment 2 in span-wise cross-section taken along the trailing-edge-side span line 27*c*, the blade 20 preferably has the blade height h set as described below with reference to Embodiment 3 in span-wise cross-section taken along the trailing-edge-side span line 27*c*. Features not particularly mentioned in the following description of Embodiment 3 are assumed to be similar to those described above with reference to Embodiment 1 or Embodiment 2.

Figure 10:
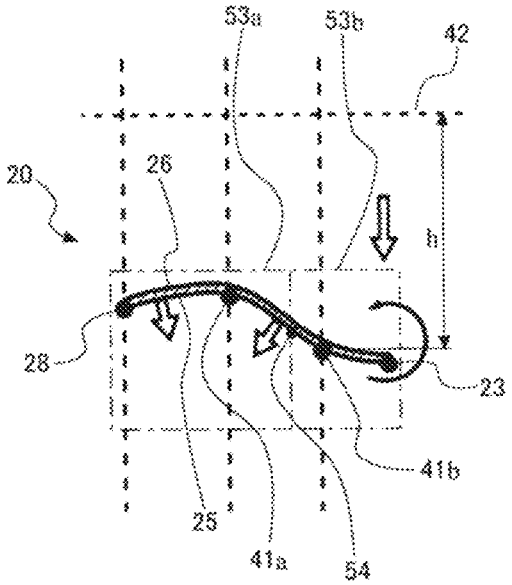
FIG. 10 illustrates a blade of an impeller according to Embodiment 3 in span-wise cross-section taken along the trailing-edge-side span line, depicting in enlarged scale a major portion of the blade corresponding a region from the radially middle part to an outboard edge part 23.

FIG. 10 illustrates a blade of an impeller according to Embodiment 3 in span-wise cross-section taken along the trailing-edge-side span line, depicting in enlarged scale a major portion of the blade corresponding to a region from the radially middle part to the outboard edge part 23.

In other words, FIG. 10 illustrates the blade 20 of the impeller 10 according to Embodiment 2 in cross-section taken along the plane V-V illustrated in FIG. 2. That is, in FIG. 10, the up-down direction in the plane of the figure represents the direction along the rotational axis 11. The upper side in the plane of FIG. 10 represents the suction side of the impeller 10, and the lower side in the plane of FIG. 10 represents the discharge side of the impeller 10.

As with Embodiment 2, in span-wise cross-section taken along the trailing-edge-side span line 27*c*, the blade 20 of the impeller 10 according to Embodiment 3 has the trailing-edge-side convexity 53*a* and the trailing-edge-side concavity 53*b*, which are positioned in sequence from the radially middle part 28 to the outboard edge part 23. Consequently, in span-wise cross-section taken along the trailing-edge-side span line 27*c*, the blade 20 has a plurality of stationary points from the radially middle part 28 to the outboard edge part 23.

More specifically, in span-wise cross-section taken along the trailing-edge-side span line 27*c*, a trailing-edge-side inflection point 54 is defined as the boundary point between the trailing-edge-side convexity 53*a* and the trailing-edge-side concavity 53*b*. With the trailing-edge-side inflection point 54 defined as described above, in span-wise cross-section taken along the trailing-edge-side span line 27*c*, the blade 20 has a first trailing-edge-side stationary point 41*a* between the radially middle part 28 and the trailing-edge-side inflection point 54. Further, in span-wise cross-section taken along the trailing-edge-side span line 27*c*, the blade 20 has a second trailing-edge-side stationary point 41*b* between the trailing-edge-side inflection point 54 and the outboard edge part 23.

According to Embodiment 3, in span-wise cross-section taken along the trailing-edge-side span line 27*c*, the blade 20 has the blade height h described below. In span-wise cross-section taken along the trailing-edge-side span line 27*c*, the blade height h in the region between the radially middle part 28 and the first trailing-edge-side stationary point 41*a* decreases monotonically from the radially middle part 28 toward the first trailing-edge-side stationary point 41*a*. In span-wise cross-section taken along the trailing-edge-side span line 27*c*, the blade height h in the region between the first trailing-edge-side stationary point 41*a* and the second trailing-edge-side stationary point 41*b* increases monotonically from the first trailing-edge-side stationary point 41*a* toward the second trailing-edge-side stationary point 41*b*. In span-wise cross-section taken along the trailing-edge-side span line 27*c*, the blade height h in the region between the second trailing-edge-side stationary point 41*b* and the outboard edge part 23 increases monotonically from the second trailing-edge-side stationary point 41*b* toward the outboard edge part 23.

As described above, separation of airflow from the surface of the boss part 12 causes turbulent airflow. When the turbulent airflow flows under centrifugal force to the outboard part of the blade 20, which accounts for much of the overall work performed by the blade 20, the efficiency of the impeller 10 decreases. In this regard, if the leading edge part 21 of the blade 20 has the shape described above with reference to Embodiment 1, then the flow of air passing through a region of the pressure surface 25 between the radially middle part 28 and the first leading-edge-side stationary point 40*a* helps to reduce the risk of the above-mentioned turbulent airflow flowing toward the outboard part of the blade 20. Further, if the trailing edge part 22 of the blade 20 has the shape described above with reference to Embodiment 3, then the risk of the above-mentioned turbulent airflow flowing toward the outboard part of the blade 20 can be reduced also at the trailing edge part 22 of the blade 20. This results in further improved efficiency of the impeller 10.

This is explained below in more detail. When air at the trailing edge part 22 of the blade 20 passes through a region of the pressure surface 25 between the radially middle part 28 and the first trailing-edge-side stationary point 41*a*, the air experiences a force that is directed toward the outboard part of the blade 20. In contrast, when air at the trailing edge part 22 of the blade 20 passes through a region of the pressure surface 25 between the first trailing-edge-side stationary point 41*a* and the second trailing-edge-side stationary point 41*b*, the air experiences a force that is directed toward the boss part 12. Due to these forces, a turbulent airflow caused by flow separation at the surface of the boss part 12 flows out of the blade 20 rearward from the vicinity of the first trailing-edge-side stationary point 41*a*. Therefore, by making the trailing edge part 22 of the blade 20 have the above-mentioned shape according to Embodiment 3, the risk of the above-mentioned turbulent airflow flowing toward the outboard part of the blade 20 can be reduced also at the trailing edge part 22 of the blade 20. This results in further improved efficiency of the impeller 10.

According to Embodiment 3, in span-wise cross-section taken along the trailing-edge-side span line 27*c*, the blade height h in the region between the second trailing-edge-side stationary point 41*b* and the outboard edge part 23 increases monotonically from the second trailing-edge-side stationary point 41*b* toward the outboard edge part 23 as described above. Accordingly, due to the relationship between the above-mentioned shape and the shape at the leading edge part 21 of the blade 20, the outboard part of the blade 20 where the blade 20 does a large amount of work can be increased in area. This makes it possible to reduce the torque exerted on the impeller 10. This results in further improved efficiency of the impeller 10.

Embodiment 4

By adding a shape according to Embodiment 4 described below to the blade 20 of the impeller 10 according to each of Embodiments 1 to 3, the impeller 10 can be further improved in efficiency. Features not particularly mentioned in the following description of Embodiment 4 are assumed to be similar to those described above with reference to Embodiments 1 to 3.

Figure 11:
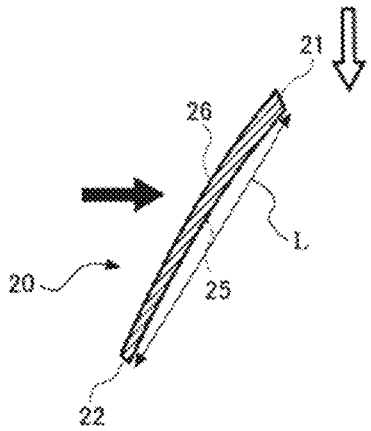
FIG. 11 illustrates a blade of an impeller according to Embodiment 4 in cylindrical cross-section centered on the rotational axis of the impeller.

FIG. 11 illustrates a blade of an impeller according to Embodiment 4 in cylindrical cross-section centered on the rotational axis of the impeller.

Prior to describing how the blade 20 of the impeller 10 according to Embodiment 4 is shaped, L is defined as illustrated in FIG. 11. More specifically, L is defined as the straight-line distance from the leading edge part 21 of the blade 20 to the trailing edge part 22 in the cylindrical cross-section centered on the rotational axis 11. As previously mentioned, with the impeller 10 observed in the direction of the rotational axis 11, with respect to the radial direction running on the blade 20, the distance from the rotational axis 11 to a given point on the blade 20 is denoted as r. As previously mentioned, with the impeller 10 observed in the direction of the rotational axis 11, with respect to the radial direction running on the blade 20, the distance from the rotational axis 11 to the inboard edge part 24 is r1, and the distance from the rotational axis 11 to the outboard edge part 23 is r2. As previously mentioned, $v=(r-r1)/(r2-r1)$. Further, $\sigma=L/r$.

With the above-mentioned definitions, the blade 20 of the impeller 10 according to Embodiment 4 has a minimum value of σ, minσ, within the range $0.5 \leq v < 0.75$, and a maximum value of σ, σmax, within the range $0.75 \leq v < 1$. This configuration makes it possible to increase the blade area in the vicinity of the outboard edge part 23 relative to the blade area in the vicinity of the radially middle part 28, and consequently to further increase the amount of work produced at the outboard part of the blade 20, which accounts for much of the overall work performed by the blade 20. The above-mentioned configuration therefore makes it possible to further improve the efficiency of the impeller 10.

Figure 12:
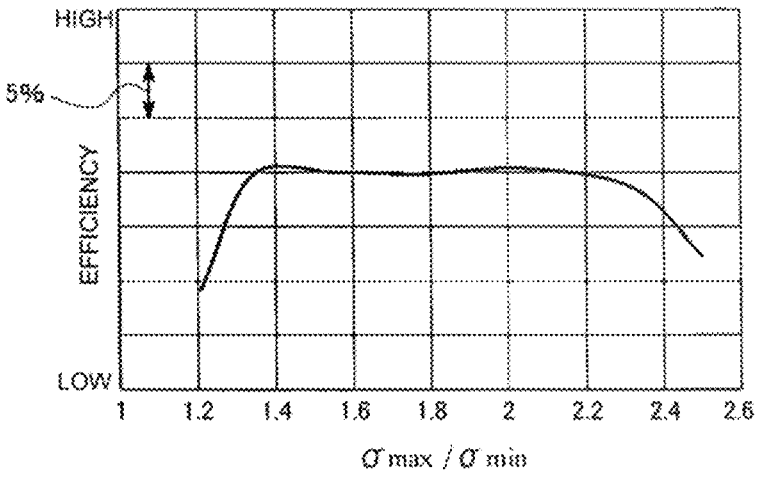
FIG. 12 illustrates, for the impeller according to Embodiment 4, the relationship between efficiency and the ratio of $\sigma max$ to $\sigma min$.

FIG. 12 illustrates, for the impeller according to Embodiment 4, the relationship between efficiency and the ratio of σmax to σmin.

It can be appreciated from FIG. 12 that the impeller 10 according to Embodiment 4 has improved efficiency if $1.4 \leq \sigma max/\sigma min \leq 2.2$ establishes.

Embodiment 5

By adding a shape according to Embodiment 5 described below to the blade 20 of the impeller 10 according to each of Embodiments 1 to 4, the impeller 10 can be further improved in efficiency. Features not particularly mentioned in the following description of Embodiment 5 are assumed to be similar to those described above with reference to Embodiments 1 to 4.

Figure 13:
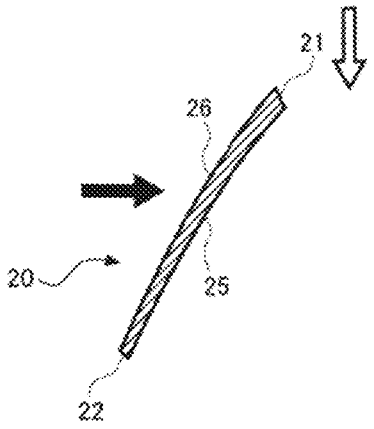
FIG. 13 illustrates a blade of an impeller according to Embodiment 5 in cylindrical cross-section centered on the rotational axis of the impeller.
Figure 14:
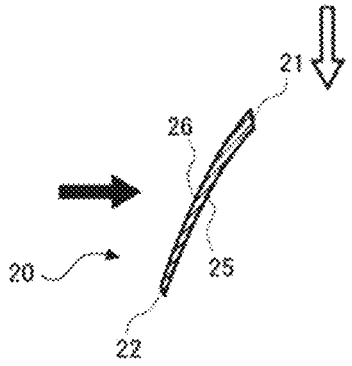
FIG. 14 illustrates a blade of the impeller according to Embodiment 5 in cylindrical cross-section centered on the rotational axis of the impeller.
Figure 15:
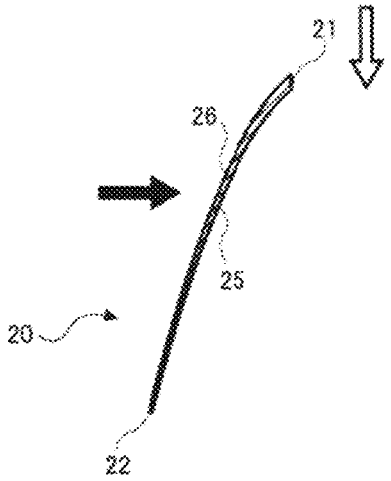
FIG. 15 illustrates a blade of the impeller according to Embodiment 5 in cylindrical cross-section centered on the rotational axis of the impeller.

FIGS. 13 to 15 each illustrate a blade of an impeller according to Embodiment 5 in cylindrical cross-section centered on the rotational axis of the impeller.

Accordingly, the up-down direction in the plane of FIGS. 13 to 15 represents the direction along the rotational axis 11. The upper side in the plane of FIGS. 13 to 15 represents the suction side of the impeller 10, and the lower side in the plane of FIGS. 13 to 15 represents the discharge side of the impeller 10. More specifically, FIG. 13 illustrates the blade 20 of the impeller 10 according to Embodiment 5 in cross-section taken along the plane XIV-XIV of FIG. 2. That is, FIG. 13 illustrates the blade 20 of the impeller 10 according to Embodiment 5 in cylindrical cross-section centered on the rotational axis 11, taken at a position on the blade 20 that is closer to the inboard edge part 24 than is the radially middle part 28. FIG. 14 illustrates the blade 20 of the impeller 10 according to Embodiment 5 in cross-section taken along the plane XV-XV Illustrated in FIG. 2. That is, FIG. 14 illustrates the blade 20 of the impeller 10 according to Embodiment 5 in cylindrical cross-section centered on the rotational axis 11, taken at the location of the radially middle part 28. FIG. 15 illustrates the blade 20 of the impeller 10 according to Embodiment 5 in cross-section taken along the XVI-XVI Illustrated in FIG. 2. That is, FIG. 15 illustrates the blade 20 of the impeller 10 according to Embodiment 5 in cylindrical cross-section centered on the rotational axis 11, taken at a position on the blade 20 that is closer to the outboard edge part 23 than is the radially middle part 28.

As illustrated in FIGS. 13 to 15, in cylindrical cross-section centered on the rotational axis 11, the blade 20 of the impeller 10 according to Embodiment 5 has a shape such that at any position from the inboard edge part 24 to the outboard edge part 23, the suction side of the impeller 10 is convex, with no inflection point between the leading edge part 21 and the trailing edge part 22. In other words, in cylindrical cross-section centered on the rotational axis 11, the blade 20 of the impeller 10 according to Embodiment 5 has a shape such that the suction side of the impeller 10 is convex in its entirety. In still other words, in cylindrical cross-section centered on the rotational axis 11, the blade 20 of the impeller 10 according to Embodiment 5 has a shape such that the discharge side of the impeller 10 is concave in its entirety.

If it is assumed, for instance, that in cylindrical cross-section centered on the rotational axis 11, the discharge side of the impeller 10 has a convexity near the trailing edge part 22 of the blade 20. Such a configuration results in decreased pressure rise of the impeller 10 since no work is done by the blade 20 in a part of the blade 20 located closer to the trailing edge part 22 than is the convexity. In contrast, in the impeller 10 according to Embodiment 5, the blade 20 has, in cylindrical cross-section centered on the rotational axis 11, a shape such that the suction side of the impeller 10 is convex in its entirety. That is, in the impeller 10 according to Embodiment 5, the blade 20 has, in cylindrical cross-section centered on the rotational axis 11, a shape such that the discharge side of the impeller 10 is concave in its entirety. This configuration allows for increased pressure rise of the impeller 10 according to Embodiment 5. Therefore, by adding the above-mentioned shape according to Embodiment 5 to the blade 20, the impeller 10 can be further improved in efficiency.

Embodiment 6

Embodiment 6 introduces an example of the fan 100 including the impeller 10 according to any one of Embodiments 1 to 5. Features not particularly mentioned in the following description of Embodiment 6 are assumed to be similar to those described above with reference to Embodiments 1 to 5.

Figure 16:
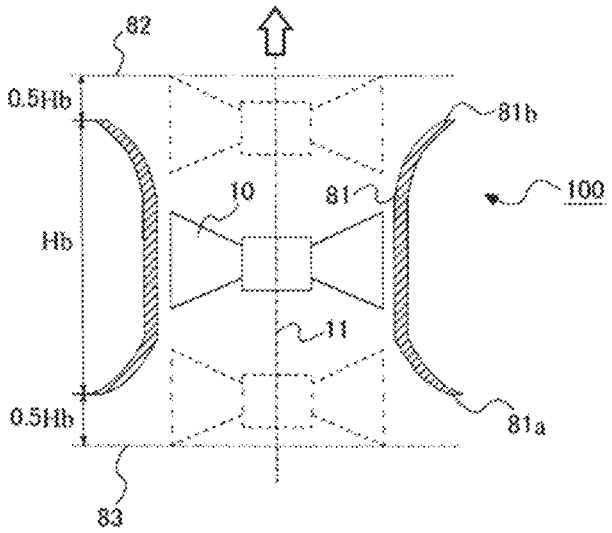
FIG. 16 illustrates a fan according to Embodiment 6 in cross-section taken parallel to the rotational axis of an impeller.

FIG. 16 illustrates a fan according to Embodiment 6 in cross-section taken parallel to the rotational axis of an impeller.

FIG. 16 illustrates a schematic representation of the impeller 10. Accordingly, for more detailed description of the shape of the impeller 10, reference is to be made to Embodiments 1 to 5. The dashed lines in FIG. 16 represent the limit position where the impeller 10 can be placed. In FIG. 16, the lower side in the plane of FIG. 6 represents the suction side of the fan 100, that is, the suction side of the impeller 10. In FIG. 16, the upper side in the plane of FIG. 16 represents the discharge side of the fan 100, that is, the discharge side of the impeller 10.

As described above with reference to Embodiment 1, the fan 100 includes the impeller 10, and the bellmouth 81 surrounding the outboard part of the impeller 10. The impeller 10 in this case is the impeller 10 according to any one of Embodiments 1 to 5. The bellmouth 81 is substantially cylindrical in shape.

According to Embodiment 6, the bellmouth 81 has an end 81*a* that is located near the discharge side of the impeller 10, and that increases in diameter toward the outer part of the bellmouth 81. In FIG. 16, the end 81*a* of the bellmouth 81 increases in diameter toward the lower side in the plane of FIG. 16. The above-mentioned shape of the end 81*a* is, however, one exemplary shape of the end 81*a*. The end 81*a* of the bellmouth 81 may be of any shape as long as the end 81*a* does not decrease in diameter toward the outer part of the bellmouth 81.

Likewise, according to Embodiment 6, the bellmouth 81 has an end 81*b* that is located near the suction side of the impeller 10, and that increases in diameter toward the outer part of the bellmouth 81. In FIG. 16, the end 81*b* of the bellmouth 81 increases in diameter toward the upper side in the plane of FIG. 16. The above-mentioned shape of the end 81*b* is, however, one exemplary shape of the end 81*b*. The end 81*b* of the bellmouth 81 may be of any shape as long as the end 81*b* does not decrease in diameter toward the outer part of the bellmouth 81.

As described above, the impeller 10 according to any one of Embodiments 1 to 5 makes it possible to achieve both improved efficiency and reduced noise. Accordingly, the fan 100 including the impeller 10 mentioned above likewise makes it possible to achieve both improved efficiency and reduced noise.

As seen in the direction of the rotational axis 11, the bellmouth 81 does not necessarily have to surround the entire outboard part of the impeller 10 but may surround only a portion of the outboard part of the impeller 10. Reference is now made to where the impeller 10 is to be placed relative to the bellmouth 81 to achieve the fan 100 that allows for both improved efficiency and reduced noise.

As illustrated in FIG. 16, the bellmouth 81 has a height Hb in the direction of the rotational axis 11. A suction-side imaginary plane 82 is defined as an imaginary plane that is perpendicular to the rotational axis 11, and that is spaced apart from the end 81*b* of the bellmouth 81 by 0.5Hb in the direction of the rotational axis 11. A discharge-side imaginary plane 83 is defined as an imaginary plane that is perpendicular to the rotational axis 11, and that is spaced apart from the end 81*a* of the bellmouth 81 by 0.5Hb in the direction of the rotational axis 11. With these planes as described above, the impeller 10 may simply be placed between the suction-side imaginary plane 82 and the discharge-side imaginary plane 83. Placing the impeller 10 at such a location makes it possible to achieve the fan 100 that allows for both improved efficiency and reduced noise.

Embodiment 7

Embodiment 7 introduces an example of an air-conditioning apparatus 200 including the impeller 10 according to any one of Embodiments 1 to Embodiment 5. Features not particularly mentioned in the following description of Embodiment 7 are assumed to be similar to those described above with reference to Embodiments 1 to 6.

Figure 17:
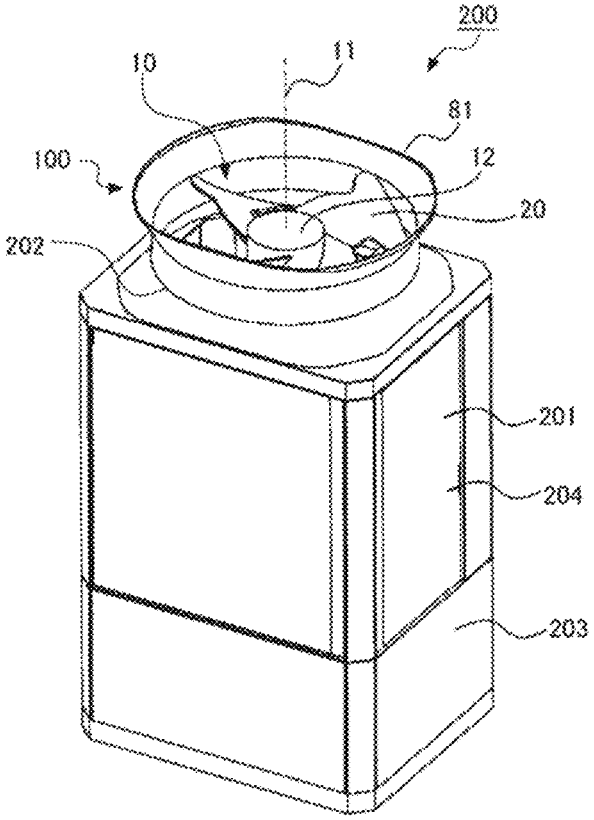
FIG. 17 is a perspective view of an air-conditioning apparatus according to Embodiment 7.

FIG. 17 is a perspective view of an air-conditioning apparatus according to Embodiment 7.

FIG. 17 illustrates an example of the air-conditioning apparatus 200 in the form of a variable refrigerant flow (VRF) system with an outdoor unit incorporating the impeller 10 according to any one of Embodiments 1 to 5.

The air-conditioning apparatus 200 includes the impeller 10 according to any one of Embodiments 1 to 5, and a heat exchanger 204. The heat exchanger 204 is configured to exchange heat between air supplied by the impeller 10, and refrigerant circulating inside the heat exchanger 204. According to Embodiment 7, the air-conditioning apparatus 200 includes a housing 203 that accommodates the heat exchanger 204.

The housing 203 is in the form of a substantially cuboid box. The top part of the housing 203 includes an air outlet 202 through which the air inside the housing 203 is to be discharged out of the housing 203. The air outlet 202 is provided with the bellmouth 81. The impeller 10 is disposed inboard of the bellmouth 81. That is, the bellmouth 81 and the impeller 10 constitute the fan 100.

The lateral faces of the housing 203 each include an air inlet 201 through which outdoor air is to be sucked into the housing 203. Not all of the lateral faces of the housing 203 need to include the air inlet 201. Only one or some of the lateral faces of the housing 203 may include the air inlet 201.

The heat exchanger 204 is disposed inside the housing 203, at a location within an airflow path extending from the air inlet 201 to the air outlet 202. According to Embodiment 7, the heat exchanger 204 is positioned to face the air inlet 201.

When the impeller 10 rotates, outdoor air is sucked into the housing 203 through the air inlet 201. As the outdoor air sucked into the housing 203 passes through the heat exchanger 204, heat is exchanged between the outdoor air, and the refrigerant flowing in the heat exchanger 204. More specifically, during cooling operation, the refrigerant flowing in the heat exchanger 204 rejects, to the outdoor air, the heat that the refrigerant has absorbed from the indoor air. During heating operation, the refrigerant flowing in the heat exchanger 204 absorbs, from the outdoor air, the heat for heating the indoor air.

As described above, the air-conditioning apparatus 200 according to Embodiment 7 includes the impeller 10 according to any one of Embodiments 1 to 5, and the heat exchanger 204, which is configured to exchange heat between air supplied by the impeller 10 and refrigerant circulating inside the heat exchanger 204. The impeller 10 according to any one of Embodiments 1 to 5 makes it possible to achieve both improved efficiency and reduced noise as mentioned above. Therefore, the air-conditioning apparatus 200 including the impeller 10 mentioned above allows for improved power efficiency, and also allows for reduced noise.

REFERENCE SIGNS LIST

10: impeller, 11: rotational axis, 12: boss part, 12*a*: mid-boss point, 20: blade, 21: leading edge part, 22: trailing edge part, 23: outboard edge part, 23*a*: outboard leading end, 23*b*: outboard trailing end, 24: inboard edge part, 24*a*: inboard leading end, 24*b*: inboard leading end, 25: pressure surface, 26: suction surface, 27*a*: leading-edge-side span line, 27*b*: middle span line, 27*c*: trailing-edge-side span line, 28: radially middle part, 30: blade tip vortex, 40*a*: first leading-edge-side stationary point, 40*b*: second leading-edge-side stationary point, 40*c*: third leading-edge-side stationary point, 41*a*: first trailing-edge-side stationary point, 41*b*: second trailing-edge-side stationary point, 42: mid-boss imaginary plane, 51*a*: first leading-edge-side concavity, 51*b*: leading-edge-side convexity, 51*c*: second leading-edge-side concavity, 52*a*: first leading-edge-side inflection point, 52*b*: second leading-edge-side inflection point, 53*a*: trailing-edge-side convexity, 53*b*: trailing-edge-side concavity, 54: trailing-edge-side inflection point, 80: casing, 81: bellmouth, 81*a*: end, 81*b*: end, 82: suction-side imaginary plane, 83: discharge-side imaginary plane, 100: fan, 200: air-conditioning apparatus, 201: air inlet, 202: air outlet, 203: housing, 204: heat exchanger.

The invention claimed is:

1. An impeller comprising:

a boss part configured to rotate about a rotational axis; and a blade disposed on an outer periphery of the boss part, the blade being rotatable about the rotational axis together with the boss part, wherein the blade includes a leading edge part being an edge part located forward in a rotational direction of the blade, a trailing edge part being an edge part located rearward in the rotational direction, an outboard edge part being an edge part located at an outboard part of the blade, and an inboard edge part being an edge part located at an inboard part of the blade, wherein a direction from the rotational axis, the direction being perpendicular to the rotational axis, is a radial direction, wherein a position on the blade that is midway between the outboard edge part and the inboard edge part is a radially middle part, wherein the blade has a plurality of cylindrical cross-sections centered on the rotational axis, wherein in each of the plurality of cylindrical cross-sections, a span line is defined such that points where a distance from the leading edge part and a distance from the trailing edge part have a predetermined ratio relative to each other are extracted, and the extracted points are interconnected from the inboard edge part to the outboard edge part to form the span line, wherein the span line includes a middle span line defined by interconnecting, from the inboard edge part to the outboard edge part, the points that are equidistant from the leading edge part and the trailing edge part, and a leading-edge-side span line located closer to the leading edge part than is the middle span line, wherein the blade has a spanwise cross-section, the span-wise cross-section being defined as a cross-section taken along the span line and parallel to the rotational axis, wherein a point on the outer periphery of the boss part is a mid-boss point, the point being a midpoint between an end of the leading edge part that is an end located at the boss part, and an end of the trailing edge part that is an end located at the boss part, wherein an imaginary plane passing through the mid-boss point and perpendicular to the rotational axis is a mid-boss imaginary plane, wherein the blade has a blade height, the blade height being defined as a distance between the mid-boss imaginary plane and the blade in a direction of the rotational axis, wherein in the span-wise cross-section taken along the leading-edge-side span line, the blade has, in sequence from the radially middle part to the outboard edge part, a first leading-edge-side concavity where a suction side of the impeller is concave, a leading-edge-side convexity where the suction side is convex, and a second leading-edge-side concavity where the suction side is concave, wherein a first leading-edge-side inflection point is defined as a boundary point between the first leading-edge-side concavity and the leading-edge-side convexity, wherein a second leading-edge-side inflection point is defined as a boundary point between the leading-edge-side convexity and the second leading-edge-side concavity, wherein the blade has a first leading-edge-side stationary point between the radially middle part and the first leading-edge-side inflection point, a second leading-edge-side stationary point between the first leading-edge-side inflection point and the second leading-edge-side inflection point, and a third leading-edge-side stationary point between the second leading-edge-side inflection point and the outboard edge part, wherein the blade height in a region between the radially middle part and the first leading-edge-side stationary point decreases monotonically from the radially middle part toward the first leading-edge-side stationary point, wherein the blade height in a region between the first leading-edge-side stationary point and the second leading-edge-side stationary point increases monotonically from the first leading-edge-side stationary point toward the second leading-edge-side stationary point, wherein the blade height in a region between the second leading-edge-side stationary point and the third leading-edge-side stationary point increases monotonically from the second leading-edge-side stationary point toward the third leading-edge-side stationary point, and wherein the blade height in a region between the third leading-edge-side stationary point and the outboard edge part increases monotonically from the third leading-edge-side stationary point toward the outboard edge part.

2. The impeller of claim 1, wherein the span line includes a trailing-edge-side span line, the trailing-edge-side span line being located closer to the trailing edge part than is the middle span line, and wherein in the span-wise cross-section taken along the trailing-edge-side span line, the blade has, in sequence from the radially middle part to the outboard edge part, a trailing-edge-side convexity where the suction side is convex, and a trailing-edge-side concavity where the suction side is concave.

3. The impeller of claim 2, wherein in the span-wise cross-section taken along the trailing-edge-side span line, the blade has a trailing-edge-side inflection point defined as a boundary point between the trailing-edge-side convexity and the trailing-edge-side concavity, a first trailing-edge-side stationary point between the radially middle part and the trailing-edge-side inflection point, and a second trailing-edge-side stationary point between the trailing-edge-side inflection point and the outboard edge part, wherein the blade height in a region between the radially middle part and the first trailing-edge-side stationary point decreases monotonically from the radially middle part toward the first trailing-edge-side stationary point, and wherein the blade height in a region between the first trailing-edge-side stationary point and the second trailing-edge-side stationary point increases monotonically from the first trailing-edge-side stationary point toward the second trailing-edge-side stationary point.

4. The impeller of claim 3, wherein in the span-wise cross-section taken along the trailing-edge-side span line, the blade height of the blade in a region between the second trailing-edge-side stationary point and the outboard edge part increases monotonically from the second trailing-edge-side stationary point toward the outboard edge part.

5. The impeller of claim 1, wherein where in each of the plurality of cylindrical cross-sections of the blade, a straight-line distance between the leading edge part and the trailing edge part is L, with the impeller observed in the direction of the rotational axis, with respect to the radial direction running on the blade, a distance from the rotational axis to a given point on the blade is r, a distance from the rotational axis to the inboard edge part is r1, and a distance from the rotational axis to the outboard edge part is r2, σ has a minimum value falling within a range 0.5<ν<0.75, and has a maximum value falling within a range 0.75<ν<1 where $$v = (r - r1)/(r2 - r1), \text{ and}$$

$$\sigma = L/r, \text{ and}$$

$$1.4 \leq \sigma\max/\sigma\min \leq 2.2$$

establishes where

σmin is the minimum value, and σmax is the maximum value.

6. The impeller of claim 1, wherein in each of the plurality of cylindrical cross-sections, the blade has, at any position from the inboard edge part to the outboard edge part, a shape that is convex on the suction side, and that has no inflection point between the leading edge part and the trailing edge part.

7. A fan comprising:

the impeller of claim 1; and a bellmouth surrounding an outboard part of the impeller, wherein the bellmouth has a height Hb in the direction of the rotational axis, wherein a suction-side imaginary plane is defined as an imaginary plane that is perpendicular to the rotational axis, and that is spaced apart by 0.5Hb in the direction of the rotational axis from an end of the bellmouth, the end being an end near the suction side, wherein a discharge-side imaginary plane is defined as an imaginary plane that is perpendicular to the rotational axis, and that is spaced apart by 0.5Hb in the direction of the rotational axis from an end of the bellmouth, the end being an end near the discharge side of the impeller, and wherein the impeller is disposed between the suction-side imaginary plane and the discharge-side imaginary plane.

8. An air-conditioning apparatus comprising:

the impeller of claim 1; and a heat exchanger configured to exchange heat between air supplied by the impeller, and refrigerant circulating inside the heat exchanger.

* * * * *